United States Patent [19]

Knapp et al.

[11] 4,361,126

[45] Nov. 30, 1982

[54] FUEL INJECTION VALVE

[75] Inventors: Heinrich Knapp, Leonberg; Manfred Lembke, Gerlingen; Mathias Linssen, Schesslitz; Jürgen Peczkowski, Bamberg; Rainer Höppel, Stuttgart, all of Fed. Rep. of Germany

[73] Assignee: Robert Bosch GmbH, Stuttgart, Fed. Rep. of Germany

[21] Appl. No.: 167,619

[22] Filed: Jul. 11, 1980

[30] Foreign Application Priority Data

Sep. 8, 1979 [DE] Fed. Rep. of Germany ..... 2936426

[51] Int. Cl.[3] ..... F02B 23/00

[52] U.S. Cl. ..... 123/585; 123/568; 123/472

[58] Field of Search ..... 123/585, 586, 587, 588, 123/589, 590, 568, 472

[56] References Cited

U.S. PATENT DOCUMENTS

| | | | |
|---|---|---|---|
| 2,860,616 | 11/1958 | Dermond | 123/585 |
| 3,416,503 | 12/1968 | High | 123/568 |
| 3,782,639 | 1/1974 | Boltz et al. | 123/472 |
| 3,788,287 | 1/1974 | Falen et al. | 123/472 |
| 3,980,056 | 9/1976 | Kraus | 123/568 |
| 4,159,703 | 7/1979 | Mayer | 123/472 |
| 4,216,753 | 8/1980 | Inoue et al. | 123/445 |

FOREIGN PATENT DOCUMENTS

| | | | |
|---|---|---|---|
| 605040 | 4/1978 | U.S.S.R. | 123/585 |

*Primary Examiner*—Ira S. Lazarus
*Assistant Examiner*—Magdalen Moy
*Attorney, Agent, or Firm*—Edwin E. Greigg

[57] ABSTRACT

A fuel injection valve is proposed which, especially in low-fuel-pressure systems, serves to inject fuel into the intake tube of a mixture-compressing internal combustion engine with externally supplied ignition. The fuel injection valve includes a fixed valve seat cooperating with a movable valve element, downstream of which the fuel to be injected is carried into a mixture guidance channel of a mixture guidance tube and surrounded on all sides with air or exhaust gas for preparation immediately upon its entrance into the mixture guidance channel and injected via an injection opening into the intake tube. The mixture guidance channel may be embodied as tapering in conical fashion toward the injection opening. For the purpose of preliminary preparation of the fuel, secondary air or exhaust gas can already be delivered to the fuel before its entrance into the mixture guidance channel. The fuel injection valve embodied according to the invention assures optimal preparation of the fuel to be injected, even at low fuel pressures, and good running behavior of the engine in the event of abrupt changes in load.

3 Claims, 4 Drawing Figures

FUEL INJECTION VALVE

BACKGROUND OF THE INVENTION

The invention relates to a fuel injection valve with preparation of the fuel to be injected into an intake tube of an internal combustion engine with a gaseous mixture. A fuel injection valve is already known in which the fuel to be injected is supplied with air for preparation immediately before injection, and in which the mixture is then ejected in the immediate vicinity of the intake tube.

OBJECT AND SUMMARY OF THE INVENTION

When the fuel injection valve according to the invention is open, the fuel to be injected is carried downstream of a valve seat into a mixture guidance channel of a mixture guidance tube. Immediately upon entrance of the fuel into the mixture guidance channel, it is surrounded on all sides by preparation air or exhaust gas and is injected into the intake tube via an injection opening.

In order to attain high flow velocities in the mixture guidance channel, the maximum cross section of the mixture guidance channel is kept as small as possible, preferably not exceeding approximately three times the cross section of the injection opening.

Also, the mixture guidance channel may be tapered along its entire length in conical fashion toward the injection opening to favorably influence the mixture flow velocity.

The fuel injection valve described herein has the advantage over the prior art that the intensively prepared mixture can be transported in the desired manner, even at low fuel pressures, to a point which is as close as possible to and before the inlet valve of the engine, and smooth engine running is assured even in the event of abrupt changes in load.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
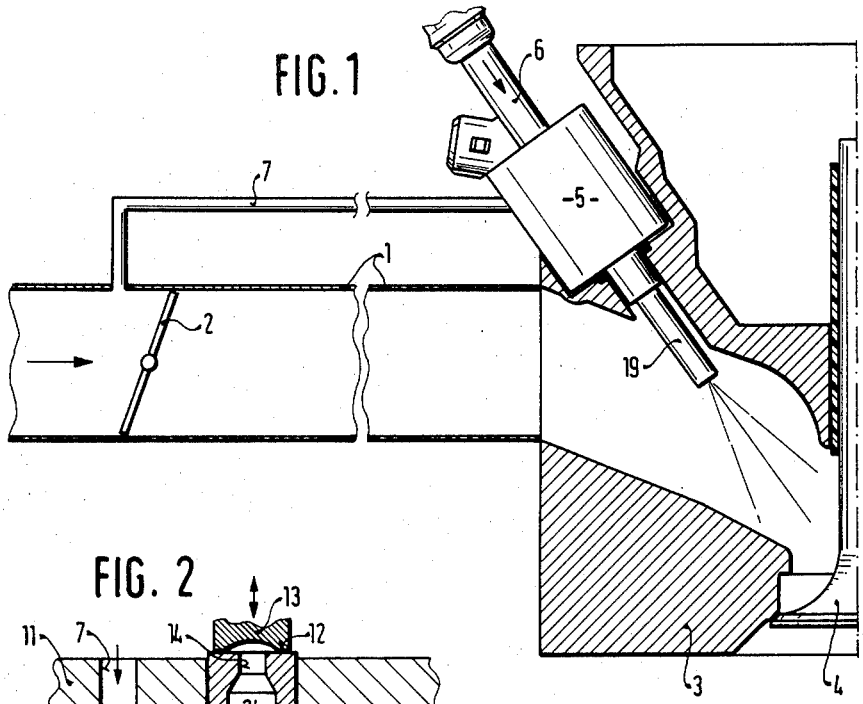
FIG. 1 shows a view of an improved fuel injection valve of the type disclosed herein positioned in an internal combustion engine.

FIG. 1 shows an intake tube 1, in which a throttle valve 2 is disposed. The intake tube 1 discharges into a cylinder 3 of a mixture-compressing internal combustion engine having externally supplied ignition, and the inlet into the cylinder is controlled by an inlet valve 4. Directly upstream of the inlet valve, there is a fuel injection valve 5, through which fuel can be injected into the suction tube 1 in the immediate vicinity of the inlet valve 4. The illustrated fuel injection valve is, by way of example, an electromagnetically actuatable fuel injection valve, which can be triggered in a known manner by an electronic control device in accordance with operating characteristics of the engine. The fuel injection valve 5 communicates via an inlet nozzle 6 with a fuel supply line, by way of which fuel, especially at low pressure (less than 1 bar), is delivered. In low-pressure systems of this kind, good preparation of the fuel to be injected requires atomization by means of air. The air source may be compressed air or, as shown, air from the atmosphere, which is delivered to the fuel injection valve 5 via an air line 7, by way of example, which branches off from the intake tube 1 upstream of the throttle valve 2. The air line 7 may also be connected to the exhaust system of the engine, so that exhaust gas is used for preparation of the fuel to be injected. This has the advantage that in the full-load range of the engine as well, sufficiently high transport pressure is available.

Figure 2:
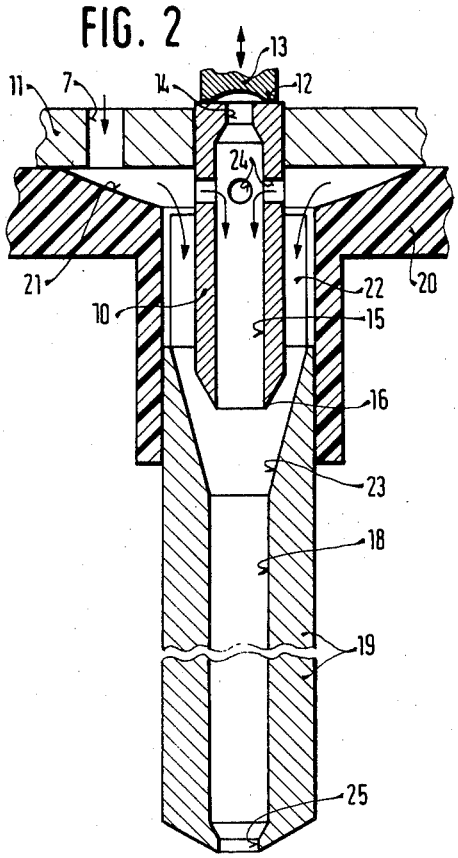
FIGS. 2–4 each show one form of embodiment of a fuel injection valve having a mixture guidance tube.

In the first exemplary embodiment of a fuel injection valve embodied according to the invention, seen in part in FIG. 2, a nozzle body 10 is inserted into a nozzle carrier 11 and its end face 12 acts as a fixed valve seat of a valve embodied in cooperation with a movable valve element 13. When the movable valve element 13 is in the raised position, fuel flows between the movable valve element 13 and the valve seat 12 to a nozzle bore 14 in the nozzle body 10. This nozzle bore 14 performs both a throttling and a fuel metering function, and from there the fuel flows into a fuel guidance channel 15 of larger diameter, which leads to the end 16 of the nozzle body 10. The nozzle body 10 protrudes with its end 16 into a mixture guidance tube 19 supported in a holder body 20, which, particularly for the sake of thermal insulation, is manufactured of plastic and at least partially surrounds the housing of the fuel injection valve. An annular recess 21 provided in the holder body 20 communicates with the air line 7 and leads to an annular channel 22. The annular channel 22 surrounds the portion of the nozzle body 10 which protrudes out of the nozzle carrier 11. A transition portion 23 of the mixture guidance tube 18 for directing air from the annular channel 22 into a mixture guidance channel 18 of the mixture guidance tube 19 may be conical in shape, as shown in FIG. 2. It may be advantageous to supply the fuel flowing by way of the fuel guidance channel 15 with secondary air or exhaust gas directly downstream of the nozzle bore 14 from the annular recess 21 via small secondary-air bores 24 or other appropriately shaped recesses. Thus a first preparation with air of the fuel to be injected is already effected, and furthermore it is assured that even at full load—that is, with approximately atmospheric pressure prevailing in the intake tube—the fuel can flow out of the fuel guidance channel 15 into the mixture guidance channel 18. The fuel stream exiting from the end 16 of the nozzle body 10 is surrounded on all sides by the primary air flow in the conical transition portion 23 guidance tube 19 and, simultaneously being thoroughly mixed with air in the mixture guidance channel 18, is carried up to the injection opening 25 at the end of the mixture guidance channel 18, avoiding any wetting of the wall. The injection opening 25 is embodied in such a way that the fuel stream, surrounded by air, can pass through into the intake tube without wetting the wall. As a result of the fact that air surrounds the fuel stream, very high flow velocities prevail in the mixture guidance channel, because friction is so low as to be negligible in contrast to the case where wetting of the wall occurs. In order to attain high flow velocities in the mixture guidance channel, it is efficient to keep the cross section of the mixture guidance channel 18 as small as possible. It is advantageous for the cross section of the mixture guidance channel to be approximately three times as large as the cross section of the injection opening 25.

Figure 3:
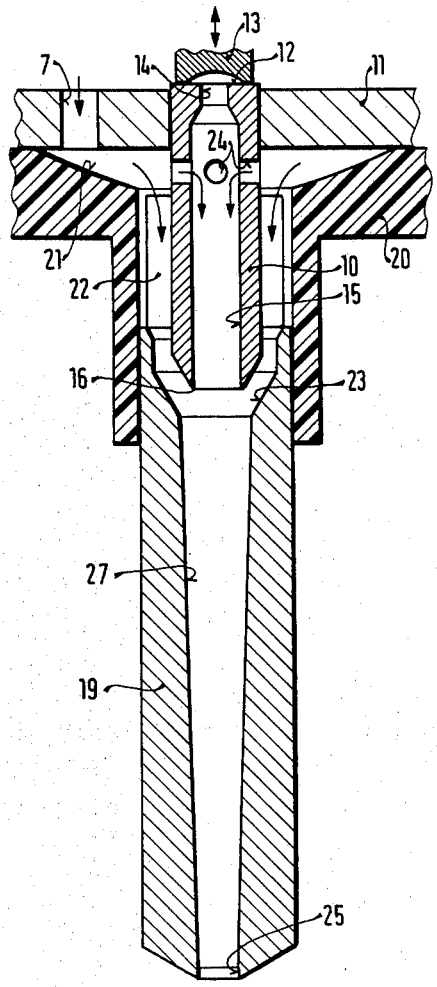

In the second exemplary embodiment of the invention shown in FIG. 3, elements which are the same as those shown in FIG. 2 are given identical reference numerals. It has proved to be advantageous, as in the exemplary embodiment of FIG. 3, to provide the mixture guidance tube 19 with a mixture guidance channel 27, which is embodied as tapering in conical fashion toward the injection opening 25. The mixture guidance channel 27 tapering conically toward the injection opening 25 not only favorably influences the flow velocity of the mixture, but also prevents so-called "dead spaces", which can cause delays in the event of load changes.

Figure 4:
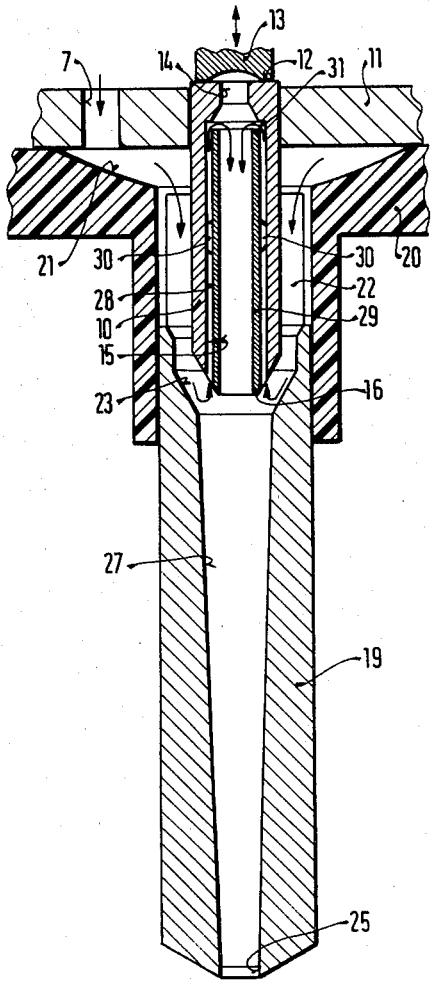

In the exemplary embodiment of FIG. 4, the secondary air for preliminary preparation of the fuel to be injected is delivered to the fuel via an annular air gap 28 directly downstream of the nozzle bore 14. The annular air gap 28 is embodied by inserting a tubule 29 into the fuel guidance channel 15, this tubule 29 having a smaller diameter than the fuel guidance channel 15 and being held by holder elements 30 at a distance from the fuel guidance channel 15. The secondary air here flows out of the primary air flow near the end 16 of the nozzle body 10 into the annular air gap 28 and proceeds to the fuel at the other end by way of an annular gap 31.

The fuel injection valves embodied in accordance with the invention enable optimal preparation of the fuel with air, even when low fuel pressures are available, while avoiding rough engine running during load changes.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection assembly for injecting a mixture of fuel and a gaseous medium into an intake tube of an internal combustion engine, which comprises:

a mixture guidance tube having an inner surface which defines a mixture guidance channel and a centrally disposed injection opening from a downstream end of the mixture guidance channel into the intake tube;

a source of pressurized fuel;

a source of pressurized gaseous medium;

a fuel injection valve connected to receive pressurized fuel from the fuel source;

first directing means, connected to receive pressurized fuel from the injection valve, for directing fuel centrally into an upstream end of the mixture guidance channel when the injection valve is open; and second directing means, connected to receive pressurized gaseous medium from the gaseous medium source, for directing gaseous medium peripherally into the upstream end of the mixture guidance channel so that the fuel entering the mixture guidance channel is surrounded by the gaseous medium entering the mixture guidance channel;

the injection opening and the mixture guidance channel being embodied so as to attain sufficiently high flow velocities of the fuel and gaseous medium therethrough so that no fuel is mixed with an outermost portion of the gaseous medium flowing over the inner surface of the mixture guidance tube during passage of the mixture through the mixture guidance channel and the injection opening into the intake tube, to thus avoid wetting of the mixture guidance tube inner surface, wherein the maximum cross section of the mixture guidance channel does not exceed three times the cross section of the injection opening.

2. A fuel injection valve as defined by claim 1, characterized in that said mixture guidance channel of said mixture guidance tube is embodied as tapering along its entire length in conical fashion toward the injection opening.

3. A fuel injection valve as defined by claim 1, which further comprises means for supplying additional air or exhaust gas for preparation to the fuel to be injected before its entrance into the mixture guidance channel.

* * * * *